US005167604A

United States Patent [19]

Ohsawa

[11] Patent Number: 5,167,604

[45] Date of Patent: Dec. 1, 1992

[54] AUTOMATIC CHOPPER BLADE OPERATING TIMING REGULATING METHOD AND APPARATUS

[75] Inventor: Shin Ohsawa, Chiba, Japan

[73] Assignee: Komori Corporation, Tokyo, Japan

[21] Appl. No.: 707,588

[22] Filed: May 30, 1991

[30] Foreign Application Priority Data

Jun. 19, 1990 [JP] Japan ..... 2-158740

[51] Int. Cl.[5] ..... B65H 45/18; B41F 13/58

[52] U.S. Cl. ..... 493/23; 493/26; 493/30; 493/417; 493/444

[58] Field of Search ..... 493/23, 26, 30, 417, 493/444, 445

[56] References Cited

U.S. PATENT DOCUMENTS 4,419,088 12/1983 Nemec ..... 493/444
4,425,110 1/1984 Gruger et al. ..... 493/444
4,481,007 11/1984 Hornung ..... 493/444

*Primary Examiner*—William E. Terrell
*Attorney, Agent, or Firm*—Abelman, Frayne & Schwab

[57] ABSTRACT

The timing of the holder blade of a folding machine is adjusted in dependence on the force exerted by a signature impacting on a locating plate, the timing of the folder blade being advanced in relation to an increase in the impact force, the actual impact force being compared with an optimal impact force, a signal representing the difference between said forces being employed to adjust the timing of the folder blade.

5 Claims, 3 Drawing Sheets

AUTOMATIC CHOPPER BLADE OPERATING TIMING REGULATING METHOD AND APPARATUS

BACKGROUND OF THE INVENTION

1. Field of the Invention

The present invention relates to a method of automatically regulating the timing of operation of the chopper blade of a chopper-type folding device incorporated into a rotary printing press, and an automatic chopper blade operating timing regulator for carrying out the same.

2. Description of the Prior Art

A web-fed rotary printing press is provided with a folding machine for cutting a printed, dried and cooled web into sheets of a predetermined length and for folding the web lengthwise or widthwise. The folding machine operates in a former fold mode to fold a web once widthwise before the web is cut, in a parallel folio fold mode to fold a sheet once in a signature, in a parallel quarto fold mode to fold a sheet twice in a quarto sheet or in a chopper fold mode to fold a parallel-folded sheet along a direction perpendicular to the fold with a chopper blade. One of those folding modes or a combination of some of those folding modes is selected according to a required folding specification.

A chopper-type folding device stops, locates and adjust the squareness of a sheet being conveyed by conveyor belts by a locating plate, folds the sheet along its center line in a signature with a plate-shaped chopper blade by lowering the chopper blade perpendicularly to the sheet and pressing the sheet in a space between gripper rollers disposed under the chopper blade.

FIG. 2 is a diagrammatic side view of a folding machine provided with two sets of chopper-type folding devices, and FIG. 3 is a diagrammatic view taken in the direction of arrows along the line III—III in FIG. 2.

Referring to FIG. 2, there are shown a web 11, a cutting cylinder 12, a folding cylinder 13, a gripping cylinder 14, an intermediate transfer cylinder 15, an upper transfer cylinder 16, a lower transfer cylinder 17, an upper chopper-type folding machine 18, and a lower chopper-type folding machine 19. The web 11 held between the cutting cylinder 12 and the folding cylinder 13 is cut into a sheet of a predetermined length by a cutting blade 20 provided on the cutting cylinder 12, and the sheet is held with needles 21 provided on the folding cylinder 13 so as to lap around the lower half circumference of the folding cylinder 13. The sheet held by the needles 21 is folded in a signature with an inserting knife 22 provided on the folding cylinder 13 and the signature is gripped with a gripping plate 23 provided on the gripping cylinder 14 so as to lap around the upper half circumference of the gripping cylinder 14, and then the signature is transferred from the gripping plate 23 to to gripping fingers 24 provided on the intermediate transfer cylinder 15. Folios thus formed are transferred alternately to the upper transfer cylinder 16 and the lower transfer cylinder 17 from the intermediate transfer cylinder 14 so as to be gripped with gripping fingers 25 and 16 provided respectively on the upper transfer cylinder 16 and the lower transfer cylinder 17. Then, the signatures are delivered to the upper chopper-type folding device 18 from the upper transfer cylinder 16 and to the lower chopper-type folding device 19 from the lower transfer cylinder 17.

As shown in FIGS. 2 and 3, the signature is conveyed along the upper surface of a plate 33 by conveyor belts 32 wound around tension pulleys 31 until they are stopped by a locating plate 34. The table 33 is provided with a slit 35 extending in the direction of travel of the signature in the central portion thereof with respect to the width. Guide plates 36 are attached to the edges of the plate 33 opposite to each other to guide the signature downward through the slit 35. A pair of upper delivery rollers 37 and 38, and a pair of lower delivery rollers 39 and 40 are disposed in that order under the guide plates 36. The delivery rollers 37, 18, 29 and 40 are driven for rotation by driving means, not shown, in the direction of arrows shown in FIG. 3. A chopper blade 41 is attached to the extremity of a swing lever 42 supported for swing motion on a shaft 43. The chopper blade 41 is located above the guide plates 36 in alignment with the slit 35. The shaft 43 is driven by driving means, not shown in synchronism with the conveyance of the signature to lower the chopper blade 41 substantially vertically into the slit 35 between the guide plates 36.

The signature conveyed along the upper surface of the plate 33 is stopped and located in correct squareness by the locating plate 34, and then the chopper blade 41 is lowered to fold the signature in a quarto sheet and to insert the quarto sheet between the delivery rollers 37 and 38. The quarto sheet is pressed between the upper delivery rollers 37 and 38 and between the lower delivery rollers 39 and 40 to fold the quarto sheet exactly. Then, the quarto sheet is transferred to a delivery unit.

The chopper-type folding device 18 (19) stops the signature and corrects the misalignment of the signature attributable to the difference in stiffness between a portion of the signature near the fold and a portion of the same remote from the fold by the locating plate 34 to locate the signature in a correct squareness for folding.

Thus, the chopper-type folding device actuates the chopper blade 41 to fold the signature after locating the signature by the locating plate 34. If the chopper blade 41 is operated at regular intervals, the signatures must be delivered at regular intervals. Therefore, the mode of impact of the signature on the locating plate 34 is dependent on the basis weight of the sheet, the width of the sheet the number of webs and the printing speed of the web-fed rotary printing press. An excessively high impact of collision between the signature and the locating plate 34 will crush the leading edge of the signature to deteriorate the quality of a signature. If the chopper blade 41 is actuated before the signature reaches the locating plate 34, the signature will be folded incorrectly.

Therefore, the chopper-type folding device is provided with a timing device for timing the operation of the chopper blade 41. A conventional timing device is operated manually by the operator to adjust the timing of operation of the chopper blade 41 observing the mode of collision of the signatures against the locating plate 34. Therefore a considerable number of waste sheets are produced during timing adjustment, and the quality of the signature is affected greatly by the level of skill of the operator. Furthermore, the timing must be adjusted every time the printing speed or the description of web is changed, which affects adversely to the productivity of the web-fed rotary printing press.

SUMMARY OF THE INVENTION

Accordingly, it is an object of the present invention to provide a method of automatically regulating the timing of operation of the chopper blade of a chopper-type folding device so that a sheet can be located correctly for folding before the actuation of the chopper blade regardless of sheet conveying speed and printing speed.

Another object of the present invention is to provide an automatic chopper blade operating timing regulator for automatically regulating the timing of operation of the chopper blade of a chopper-type folding device, capable of automatically regulating the timing of operation of the chopper blade so that the chopper blade folds a sheet after the sheet has been located in a correct squareness.

To achieve the objects, the present invention provides an automatic chopper blade operating timing regulating method of automatically regulating the timing of operation of the chopper blade of a chopper-type folding device, comprising steps of detecting an impulsive force applied to the locating plate of a chopper-type folding device by a signature, comparing the detected impulsive force with a predetermined desired impulsive force, and automatically regulating the timing of operation of the chopper blade on the basis of the result of comparison so that the actual impulsive force coincides with the desired impulsive force.

The present invention provides also an automatic chopper blade operating timing regulator for carrying out the method of automatically regulating the timing of operation of the chopper blade of a chopper-type folding device, comprising impulsive force detecting means for detecting an impulsive force applied to the locating plate of a chopper-type folding device by a signature, desired impulsive force setting means for setting an optimum impulsive force to be applied by a signature to the locating plate according to the condition of the signature, comparing means for comparing a detected impulsive force detected by the impulsive force detecting means and a desired impulsive force set the by desired impulsive force setting means, and timing regulating means for regulating the timing of operation of the chopper blade by driving means on the basis of the result of comparison provided by the comparing means.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
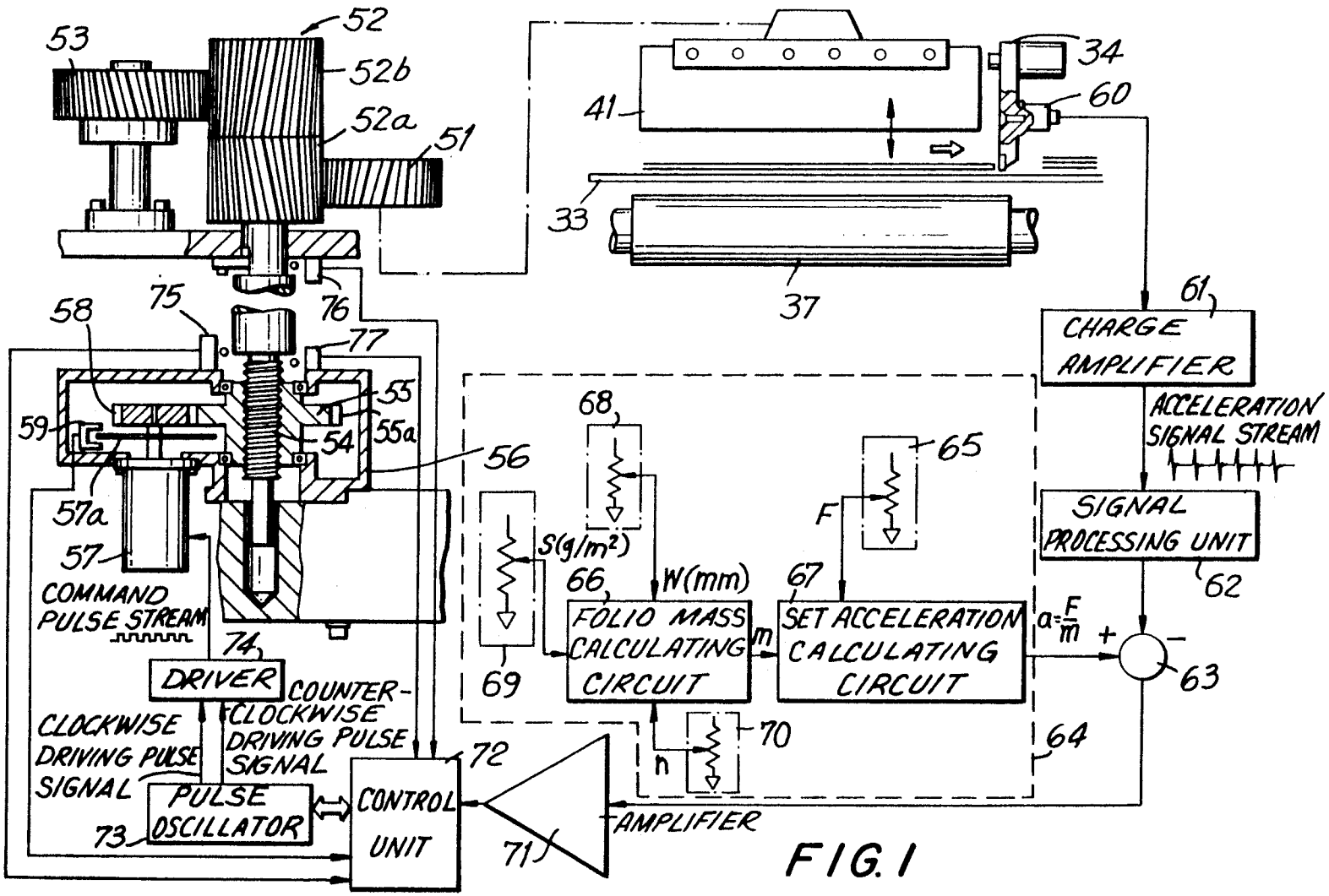
FIG. 1 is a block diagram of an automatic chopper blade operating timing regulator in a preferred embodiment according to the present invention for automatically regulating the timing of operation of the chopper blade of a chopper-type folding device.
Figure 2:
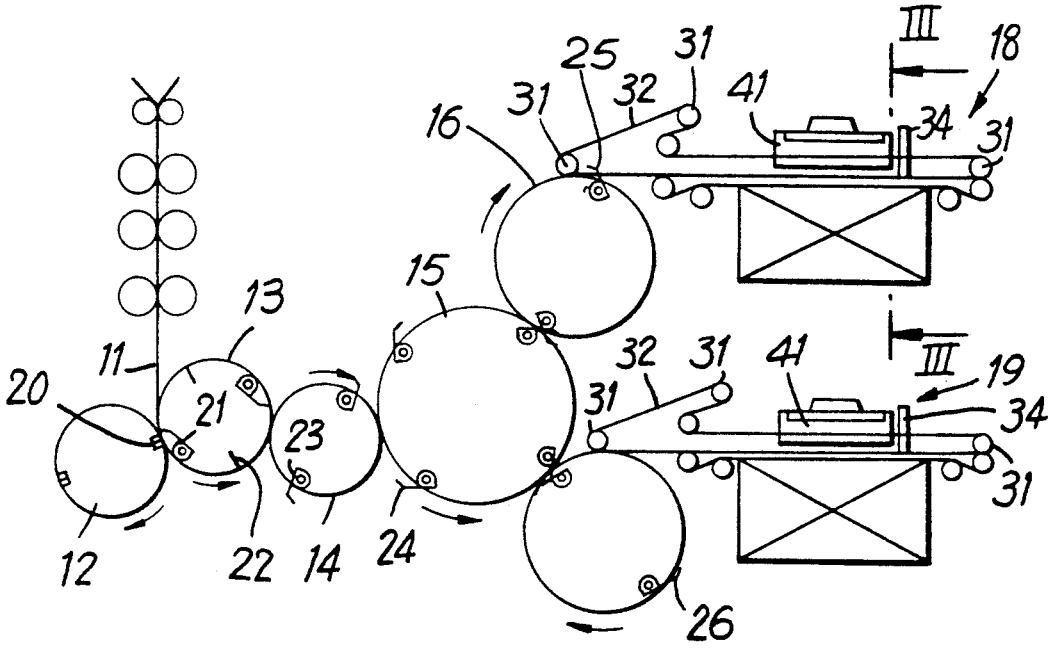
FIG. 2 is a diagrammatic side view of folding machine provided with two sets of chopper-type folding devices.
Figure 3:
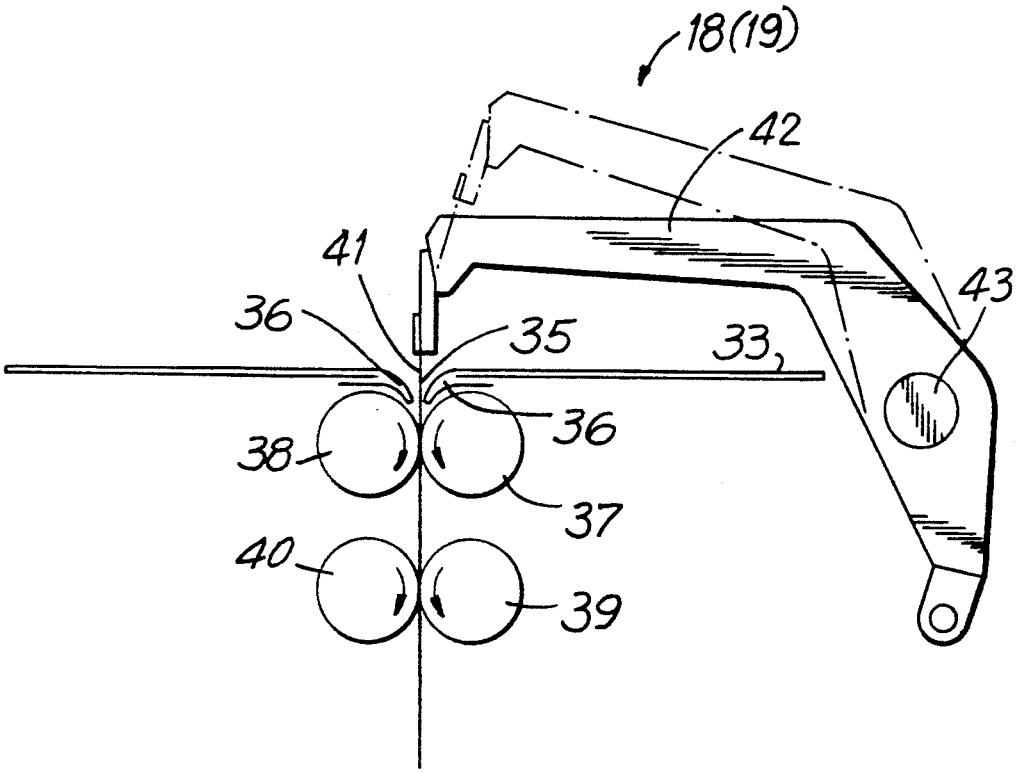
FIG. 3 is a fragmentary view taken in the direction of arrows substantially along the line III—III in FIG. 2.

Referring to FIG. 1 showing an automatic chopper blade operating timing regulator in a preferred embodiment according to the present invention in combination with a portion of a chopper-type folding device pertinent to the present invention, a driven gear 51 interlocked with a chopper blade 41 is in engagement with one of the helical gears 52*a* and 52*b*, i.e., the helical gear 52*a* in FIG. 1, of a double helical gear 52 supported for rotation and axial movement. A driving gear 53 is in engagement with the other helical gear 52*b* of the double helical gear 52. The chopper blade 41 is operated by the driving gear 53 through the double helical gear 52 and the driven gear 51. The double helical gear 52 is moved axially to change the phase of the driven gear 51 relative to the driving gear 53 to change the timing of operation of the chopper blade 41.

A threaded portion 54 formed in the shaft of the double helical gear 52 is in engagement with an internally threaded member 55 journaled on a frame 56 so that the internally threaded member 55 is unable to move axially. A gear 55*a* is formed integrally with the internally threaded member 55. The gear 55*a* is in engagement with a pinion 58 mounted on the output shaft of a stepping motor 57. The stepping motor 57 rotates the internally threaded member 55 through the pinion 58 and the gear 55*a* to move the double helical gear 52 axially by the screw jack action of the internally threaded member 55 and the threaded portion 54 of the shaft of the double helical gear 52. A slit disk 57*a* is mounted on the output shaft of the stepping motor 57, and a pulse generator 59 is associated with the slit disk 57*a* to detect the phase of the slit disk 57*a*. A timing regulating mechanism comprises, as principal components, the driven gear 51, the double helical gear 52 having the threaded portion 54, the internally threaded member 55 integrally provided with the gear 55*a*, the pinion 58 and the stepping motor 57.

A piezoelectric acceleration sensor 60, i.e., impulsive force detecting means, is provided on a locating plate 34 to detect an impulsive force applied by a signature to the locating plate 34. Detection signals provided by the acceleration sensor 60 are applied to a charge amplifier 61, the charge amplifier 61 provides an acceleration signal stream. A signal processing unit 62 receives the acceleration signal stream, averages the acceleration signal stream to obtain an average acceleration signal and gives the average acceleration signal to a comparator 63.

A desired acceleration setting unit 64, i.e., desired impulsive force setting means, for setting an optimum acceleration according to the condition of the signature gives a signal to the comparator 63. The desired acceleration setting unit 64 is provided with a set acceleration calculating circuit 67 which sets a desired acceleration on the basis of data given thereto from an impulsive force setting device 65 and a signature mass calculating circuit 66 for calculating the mass of a signature, and gives a signal representing the desired acceleration to the comparator 63.

The impulsive force setting device 65 gives a signal representing an optimum impulsive force F to the set acceleration calculating circuit 67. A sheet width W (mm), a basis weight S (g/mm$^2$) and a web number n, i.e., the number of webs to be used, are given to the signature mass calculating circuit 66 respectively from a sheet width setting device 68, a signature mass setting device 68 and a web number setting device 70. Then, the sheet weight calculating circuit 66 calculates the mass m of the signature by operating those data given thereto by using:

$$m = n \times S \times C \times W \quad (1)$$

where C is the cut length of the signature.

The set acceleration calculating circuit 67 receives the mass m of the signature and the desired impulsive force F, and gives a desired acceleration a (a=F/m) to the comparator 63.

The comparator 63 compares the acceleration signal received from the signal processing unit 62 and the desired acceleration a received from the set acceleration calculating circuit 67, and gives a signal representing the deviation of the acceleration signal from the desired acceleration a through an amplifier 71 to a control unit 72. Then, the control unit 72 gives a driving signal through a pulse oscillator 73 and a driver 74 to the stepping motor 57. The pulse oscillator 73 provides a clockwise driving pulse signal CW for driving the stepping motor 57 for rotation in a clockwise direction or a counterclockwise driving pulse signal CCW for driving the stepping motor 57 for rotation in a counterclockwise direction. When the deviation determined by the comparator 63 is a positive value, namely, when the actual acceleration of the signature is lower than a reference acceleration, the stepping motor 57 is driven so as to delay the timing of operation of the chopper blade 41. When the deviation is a negative value, namely, when the actual acceleration of the signature is higher than the reference acceleration, the stepping motor 57 is driven so as to advance the timing of operation of the chopper blade 41. The location of the double helical gear 52 at a zero-position is detected by a zero-position switch 75, an upper limit switch 76 gives a signal to the control unit 72 at the upper limit of travel of the double helical gear 52, and a lower limit switch 77 gives a signal to the control unit 72 at the lower limit of travel of the double helical gear 52. The signal generated by the pulse generator 59 is applied also to the control unit 72.

A chopper blade operating timing regulating method to be carried out by the automatic chopper blade operating timing regulator will be described hereinafter.

The chopper blade 41 is driven through the double helical gear 52 and the driven gear 51 by the driving gear 53. The acceleration sensor 60 detects an impulsive force (acceleration) applied by a signature to the locating plate 34. An acceleration signal representing the impulsive force, provided by the acceleration sensor 60 is transferred through the charge amplifier 61 and the signal processing unit 62 to the comparator 63. The desired acceleration setting device 64 sets the desired acceleration a on the basis of data provided by the impulsive force setting device 65 and the signature mass calculating circuit 66. The comparator 63 compares the acceleration signal and the desired acceleration a, and then the comparator 63 gives a deviation signal representing the deviation of the acceleration signal from the desired acceleration a through the amplifier 71 to the control unit 72.

The control unit 72 gives a drive command signal corresponding to the deviation to the driver 74, and then driver 74 applies a drive signal to the stepping motor 57 to drive the stepping motor 57. Then, the stepping motor 57 rotates the internally threaded member 55 through the driving gear 58 and the gear 55*a* to shift the double helical gear 52 axially according to the drive command signal so that the phase of the driven gear 51 relative to the driving gear 53 is changed accordingly to change the operating timing of the chopper blade 41 is changed accordingly. If the deviation determined by the comparator 63 is a positive value, namely, when the actual acceleration of the signature is lower than the reference acceleration, the operating timing of the chopper blade 41 must be delayed to reduce the deviation to zero. Therefore, a drive command signal to delay the operating timing of the chopper blade 41 is given to the driver 74 so that the stepping motor 57 rotates the driven gear 51 in a direction for delaying the operating timing of the chopper blade 41. If the deviation determined by the comparator 63 is a negative value, namely, when the actual acceleration of the signature is higher than the reference acceleration, the operating timing of the chopper blade 41 must be advanced to reduce the deviation to zero. Therefore, a drive command signal to advance the operating timing of the chopper blade 41 is give to the driver 74 so that the stepping motor 57 rotates the driven gear 51 in a direction for advancing the operating timing of the chopper blade 41. Thus, the operating timing of the chopper blade 41 is regulated automatically so that the acceleration of the signature at the impact of the same on the locating plate 34 is constant regardless of the signature conveying speed corresponding to the printing speed.

The automatic chopper blade operating timing regulator is capable of automatically regulating the chopper blade operating timing so that the impact of the signature on the locating plate 34 is constant regardless of the printing speed and, consequently, the signature can satisfactorily be folded by the chopper blade 41 in an accurate quarto sheet in an accurate squareness. Since the operator is required only to enter data of the signature, the quality of the folded sheet is not dependent on the degree of skill of the operator.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A method of automatically regulating the timing of a folder blade in a signature folding machine of the type including:

a locating plate, means for feeding a signature into impacting relation with said locating plate, and, a folder blade operated in timed relation with said signature feeding means, including the steps of:

measuring an actual force of impact of a said signature on said locating plate, and providing a first signal representative of said actual force of impact;

providing a second signal representative of an optimum force of a said signature on said locating plate;

comparing said first and second signals to provide a control signal;

employing said control signals to regulate the timing of operation of said folder blade in relation to the linear speed of feeding of said signature by said feeding means, in order to return and maintain the force of impact of said signature on said locating plate at said optimum force.

2. The method of claim 1, in which said actual force of impact is determined on the basis of the weight of a said signature.

3. The method of claim 2, in which said optimum force if determined as a force insufficient to cause damage to a leading edge of a said signature upon impact on said locating plate.

4. A device for regulating the timing of a folder blade in a signature folding machine, of the type including:

means for feeding a signature;

a locating plate positioned to intercept and stop a said signature fed by said feeding means;

a sensor carried by said locating plate for measuring the actual force of impact of a said signature on said locating plate when fed by said feeding means and providing a first signal representative of said actual force of impact;

means providing a second signal representative of an optimum impact force of a signature on said locating plate;

a comparator for comparing said first and second signals and providing a control signal;

drive means for reciprocating said folder blade; and regulating means interposed in said dive means of said folder blade for regulating the timing of operation of the folder blade drive means;

said control signal of said comparator being operatively connected to said regulating means, and being operative to adjust said regulating means in accordance with said control signal.

5. The device of claim 4, in which said regulating means includes:

a driven helical gear meshed with one helix of a double helical gear;

a drive helical gear meshed with the other helix of said double helical gear; and driven means for adjusting the axial position of said double helical gear relative to said drive and driven helical gears under the control of said control signal, said driven means and thus the position of axial adjustment of said double helical gear being controlled by said control signal.

* * * * *